US006443834B1

(12) United States Patent
Berger

(10) Patent No.: US 6,443,834 B1
(45) Date of Patent: Sep. 3, 2002

(54) SITE-OF-USE INSTALLED VENTING APPARATUS

(76) Inventor: Edwin L. Berger, 100-95 Baker Ct., Island Park, NY (US) 11558

( * ) Notice: Subject to any disclaimer, the term of this patent is extended or adjusted under 35 U.S.C. 154(b) by 0 days.

(21) Appl. No.: 10/038,339

(22) Filed: Jan. 7, 2002

(51) Int. Cl.[7] ..... F24F 13/08
(52) U.S. Cl. ..... 454/353
(58) Field of Search ..... 454/353, 354, 454/356, 359, 367, 358

(56) References Cited

U.S. PATENT DOCUMENTS 3,842,722 A * 10/1974 Miller ..... 137/527.6
4,081,915 A * 4/1978 Materniak nee Babcerowicz et al. ..... 285/9.1
4,334,461 A 6/1982 Ferguson et al.
5,662,522 A * 9/1997 Waltz ..... 454/359
5,711,091 A * 1/1998 Bos ..... 34/140
5,769,916 A * 6/1998 Immel ..... 454/272
5,916,023 A * 6/1999 Meyer ..... 34/235
6,149,516 A 11/2000 Mantyla

* cited by examiner

*Primary Examiner*—Harold Joyce
*Assistant Examiner*—Derek S. Boles
(74) *Attorney, Agent, or Firm*—Myron Ame PC

(57) ABSTRACT

A simplified installation construction for a venting device which requires from a select one of several sizes of an input diameter a correlation to a matching diameter of a flexible conduit, the simplification resulting from using an interconnection of the diameters which once made, is difficult to disconnect but is known not to require a disconnecting mode, and wherein the sizes of input diameters not used are merely discarded. This is a noteworthy alternative to attempting to correlate the diameter of a flexible conduit to all input diameter sizes of the venting device.

1 Claim, 4 Drawing Sheets

SITE-OF-USE INSTALLED VENTING APPARATUS

The present invention relates generally to improvements in venting apparatus, the improvements more particularly facilitating the installation of the venting apparatus in the field and at its site-of-use.

EXAMPLES OF THE PRIOR ART

In venting gaseous content from the interior of a building construction to atmosphere, a flexible hose is connected in spanning relation between the interior source of the gaseous content and an exterior venting construction, and the interfitting of the exit end of the hose to the inlet opening into the venting construction is critical since it should be leakproof. Typically, however, it is not known until arriving at the site of use what diameter size of flexible hose is required, and thus provision must be made in the venting construction to correlate the diameter of the flexible hose selected to the diameter of the inlet opening of the venting apparatus to achieve a leakproof interfitting therebetween.

Exemplifying one solution to the dilemma resulting from not knowing until at the site of use the diameters requiring correlating with each other is U.S. Pat. No. 6,149,516 for "Soffit Vent Apparatus" issued to Mantyla on Nov. 21, 2000 in which, at the installation site, the inlet to the venting apparatus is modified by a cutting procedure to interfit with either a 5-inch diameter hose if a kitchen dryer is to be vented or with a 4-inch diameter hose if a bathroom shower is to be vented.

Exemplifying another solution is U.S. Pat. No. 4,334,461 for "Portable Window Dryer Vent" to Ferguson et al. on Jun. 15, 1982, in which provision is made to attempt to correlate all sizes of diameters, even when the only possible diameters might be only 2 or 3 in number; this attempt to solve a greater problem than is actually encountered complicating the construction of the venting apparatus.

Broadly, it is an object of the present invention to provide a site-of-use installed venting apparatus overcoming the foregoing and other shortcomings of the prior art.

More particularly, it is an object to use to advantage the knowledge of the limited possibilities of what will be required at the site of installation with the attendant benefit of simplicity; this simplicity being a recognition that once correlating the diameters that are interfitted, they are not required to be disengaged. Thus, the interfitting mode is itself extremely simple because there is no need for, nor provision made for a disengaging mode, and thus a noteworthy on-site venting apparatus installation is provided overcoming the shortcomings of both of the prior art venting installations of the '516 or '461 patents and those known to be of a similar nature.

The description of the invention which follows, together with the accompanying drawings should not be construed as limiting the invention to the example shown and described, because those skilled in the art to which this invention appertains will be able to devise other forms thereof within the ambit of the appended claims.

A venting construction for venting to atmosphere gaseous content from within an interior room of a building construction and/or that produced in the operation of a washing or dryer apparatus in the interior room contemplates the use of an accordion pleated hose or conduit serving as a flow passage from the gaseous source to an exit opening to atmosphere. In the field installation of the conduit, it is often not determined until arrival at the site of installation what diameter of conduit is appropriate, and thus some allowance must be made in correlating the diameters of the flexible conduit and conduit-connecting structure to the on-site venting construction. Exemplary of a prior art solution addressing this problem is shown in FIGS. 1 and 2.

Figure 1:
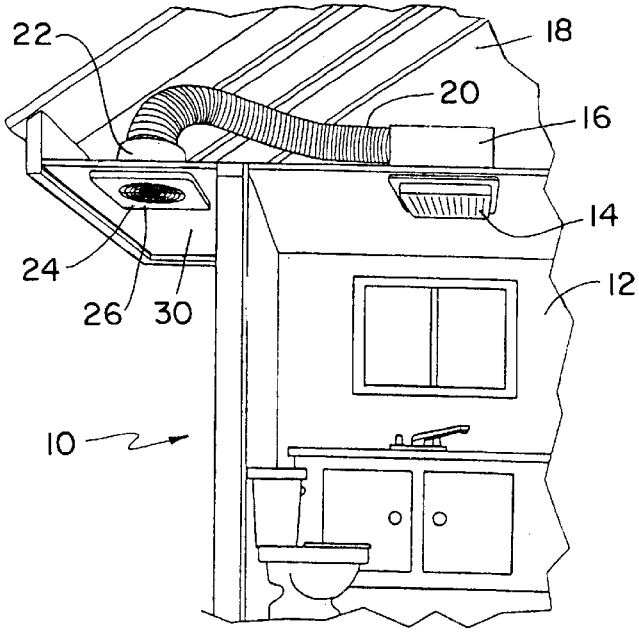
FIG.1 PRIOR ART
FIG. 1 is a cross-sectional view of a prior art bathroom, attic and soffit vent apparatus.

FIG. 1 shows a typical house 10 having a bathroom 12. The bathroom 12 contains a vent inlet 14 which is in communication with a vent fan 16 in the ceiling of the bathroom 12. Above the ceiling of the bathroom 12 is an attic 18. Within the attic 18 is a gas conduit 20 in communication with the vent fan 16. The gas conduit is attached to the soffit vent apparatus for venting gases from the enclosure to the external environment. The soffit vent apparatus comprises a duct 22 which is mounted on a vent cover 24. In the preferred embodiment shown, the cover 24 has an exterior side 26 and interior side 28 (shown in FIG. 2), and the duct is mounted on the interior side 28. The cover 24 is mounted to the soffit 30 against its interior side 28.

Figure 2:
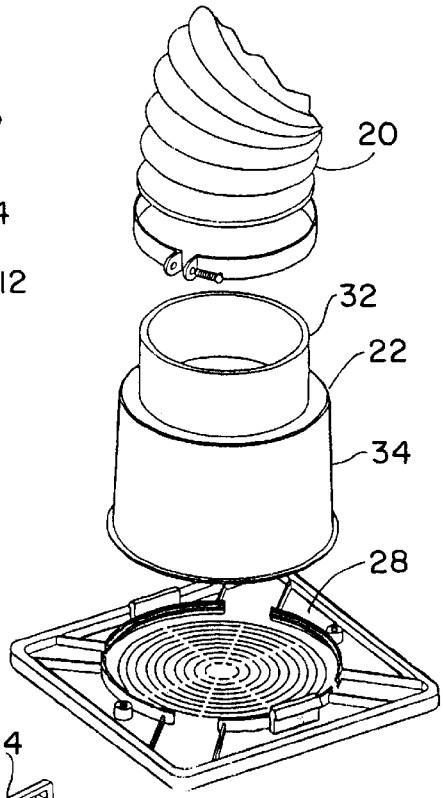
FIG.2 PRIOR ART
FIG. 2 is a perspective exploded view of the soffit vent apparatus of FIG. 1.

Referring now to FIG. 2, the duct 22, preferably being substantially circular in cross-section, preferably comprises a cylindrical upstream section 32 and a cylindrical downstream section 34 connected coaxially and operatively. Most preferably the duct is slightly conical (a narrowing taper towards the top) to aid both in removing the part from the tooling and to permit a tight fit for dryer vent and conduit applied over the exterior of the duct.

The conduit size adaptation means may be anything that allows the apparatus to be attached to at least two differently-sized conduits. Preferably, the conduit size adaptation means comprises the upstream 32 and the downstream section 34 in combination. In the most preferred embodiment the upstream section 32 is 4-inches in diameter, and the downstream section 34 is 5-inches in diameter. Thus, the duct may be fitted with a typical dryer vent conduit which is 5-inches in diameter, or with a typical bathroom vent conduit which is 4-inches in diameter. If attachment to a 4-inch conduit is desired, the duct 22 is used as provided. If attachment to a 5-inch conduit is desired, the upstream section 32 can be cut off quickly with a knife immediately prior to installation and discarded.

Another typically encountered requirement for venting occurs in the operation of household dryers or the like apparatus, and concomitantly the use of a range of graduated diameters of accordion pleated hose and adapters to correlate the diameter sizes involved. In connection with this exemplary prior art, reference should be made to FIG. 3 in which a portable window dryer vent according to the prior art has a collapsible window screen 38 comprised of two interslidable panels 40 so that the screen can be snug fitted in different widths of windows. One panel includes a frame 42 of channel shape so that the narrow frame 44 of the other panel slides therein. Each frame is fitted with either a mesh screening 46, or other paneling such as a solid transparent pane of plastic, masonite, or the like. A large hole 48 is cut in one of the panels, the hole being located near one end of the screen where it is not likely to be covered by the other sliding panel.

An air exhaust vent 50 is positioned adjacent an outer side of the hole, the vent comprising a box 52 having an opening on its bottom and an opening 56 at its rear which is closable by freely depending, pivotable flaps or louvers 58.

An adapter 60 is positioned adjacent an inner side of the hole 48 and has a notch 62 so as to clear the hole from blockage thereof. A groove 64 around opposite side and lower edges thereof serves to hold the edges of a rectangular plate 66 removably slidable into the adapter.

The plate 66 includes a central hole 68 therethrough which is the same size as hole 48. An inwardly extending flange 70 surrounds the edge of hole 68, so that an accordion pleated hose 72 from a dryer can be fitted around the flange and permanently secured thereto by means of a conventional hose clamp 74, so that the plate 66 remains permanently with the base.

Holes 76 are provided on side flanges 78 of the vent 50 and correspondingly located holes 80 are provided on side flanges 82 of the adapter so that bolts 84 can be fitted therethrough and through holes of the screen, vent and adapter as a single and permanent unit.

Figure 3:
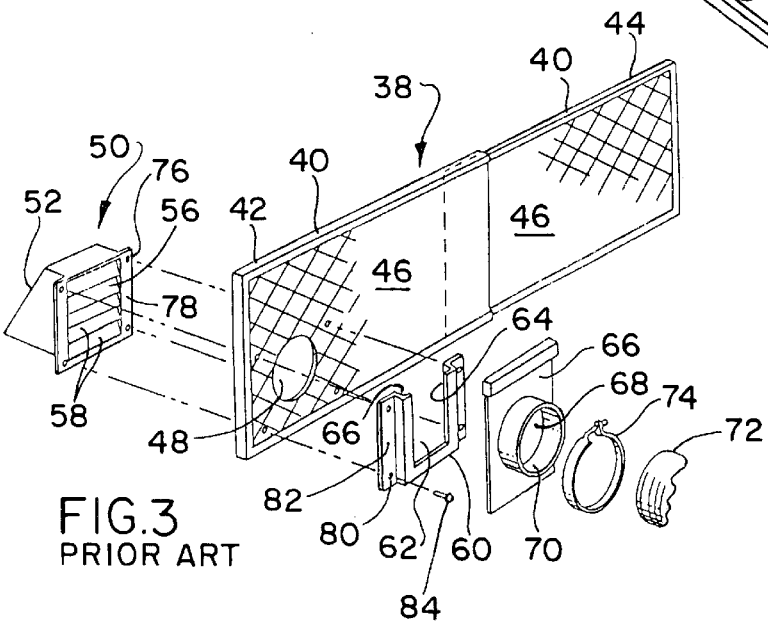
FIG.3 PRIOR ART
FIG. 3 is an exploded perspective view of another prior art soffit-type vent apparatus.

The size correlation utility of the prior art adapter of FIG. 3 is unduly and needlessly complicated because it attempts to cover all sizes of diameters that are believed to have to interfit when in the field when only two and possibly three diameter sizes in most circumstances have to be contended with, such as exemplified by field installation of the prior art venting apparatus of FIGS. 1 and 2. The drawback of the adapter field installation of FIGS. 1 and 2 is not in the diameter sizes focused upon, but in the complications of correlating the two diameter sizes to the one size encountered in the field which, is not specifically known until arriving at the size of installation, but nevertheless known to be of the two limited possibilities.

The adapter of the present invention uses to advantage the knowledge of the limited possibilities of what will be required at the site of installation with the attendant benefit of simplicity; this simplicity being a recognition that once correlating the diameters that are interfitted, they are not required to be disengaged. Thus, the interfitting mode is itself extremely simple because there is no need for, nor provision made for a disengaging mode, and thus a noteworthy on-site venting apparatus installation is provided overcoming the shortcomings of both of the prior art venting installations of FIGS. 1–3, and those of a similar nature.

Figure 4:
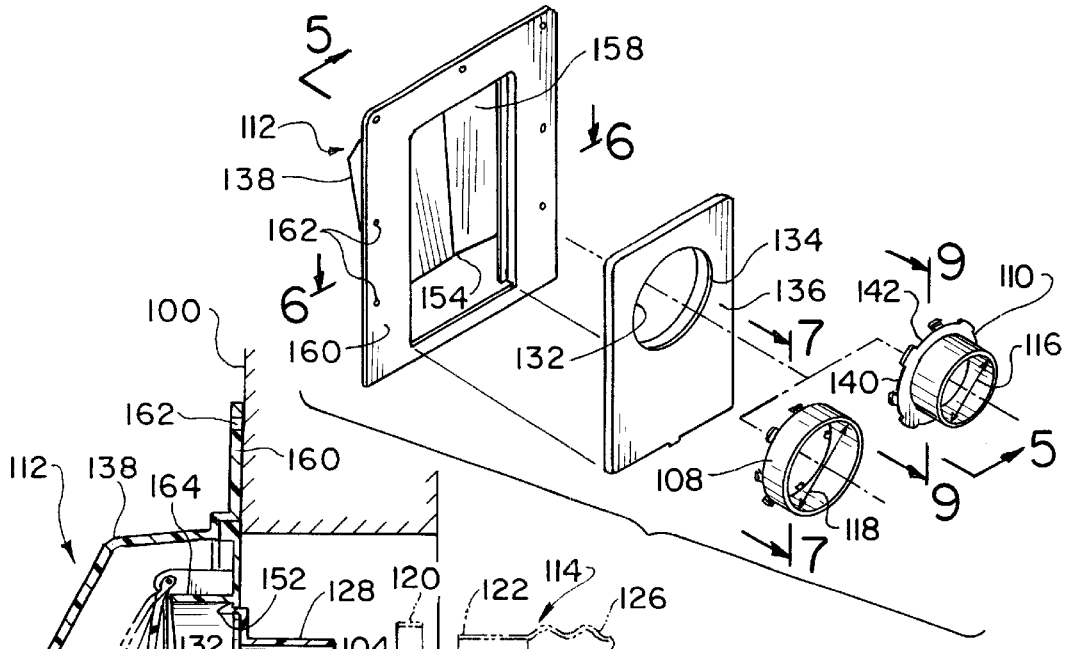
FIG. 4 is a perspective exploded view of the components of the vent apparatus of the present invention.
Figure 5:
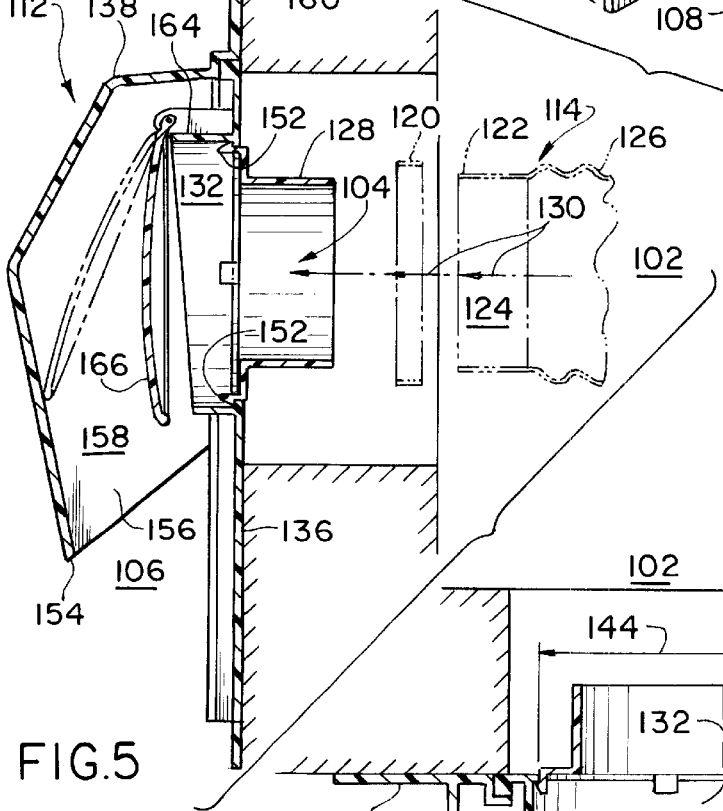
FIG. 5 is a sectional view, taken along line 5—5 of FIG. 4, of the assembled components of FIG. 4.
Figure 6:
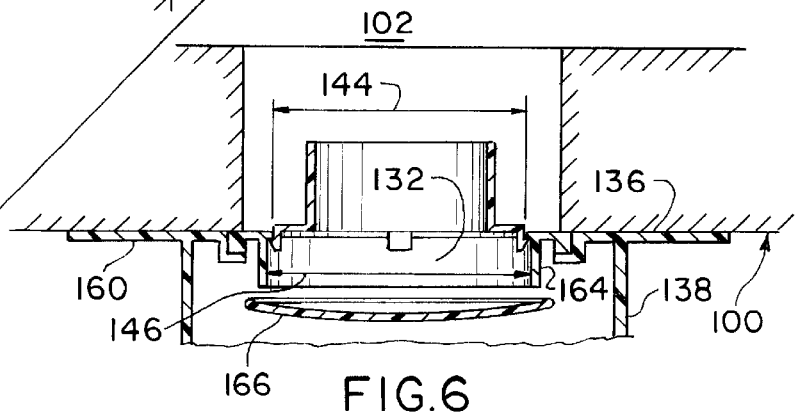
FIG. 6 is a view similar to FIG. 5, but in section taken along line 6—6 of FIG. 4.
Figure 8:
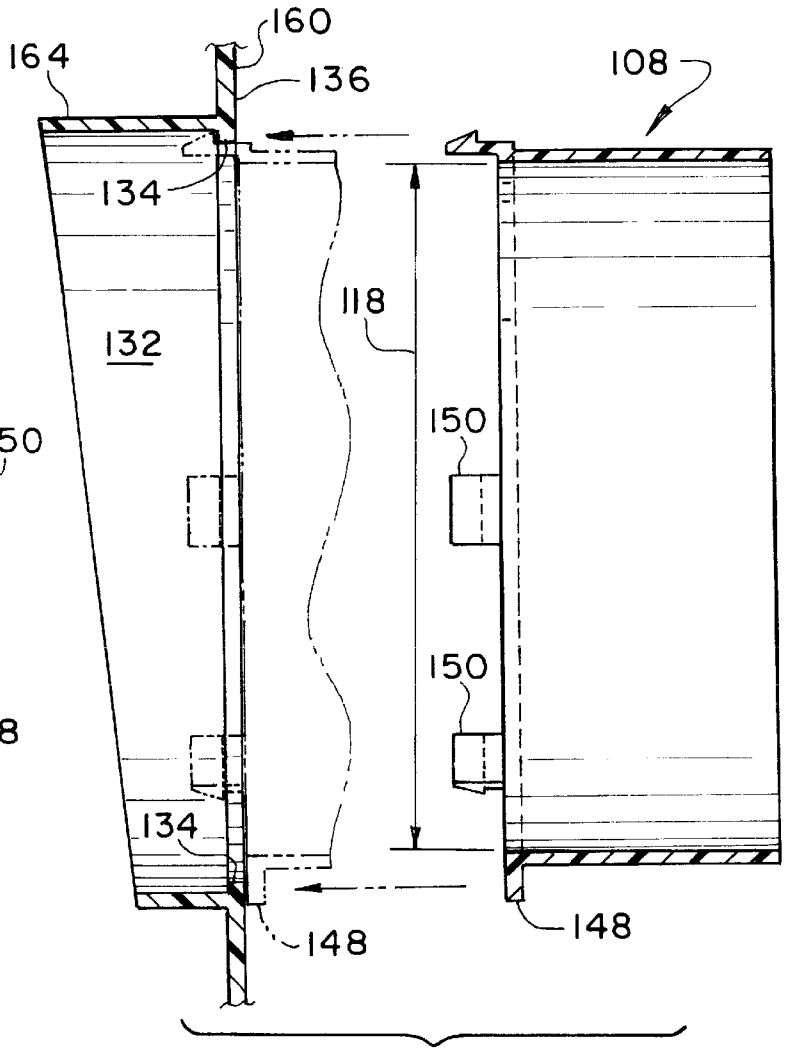
FIG. 8 are positions of movement of one rim component of FIG. 4, in section as taken along line 8–8 of FIG. 7.
Figure 7:
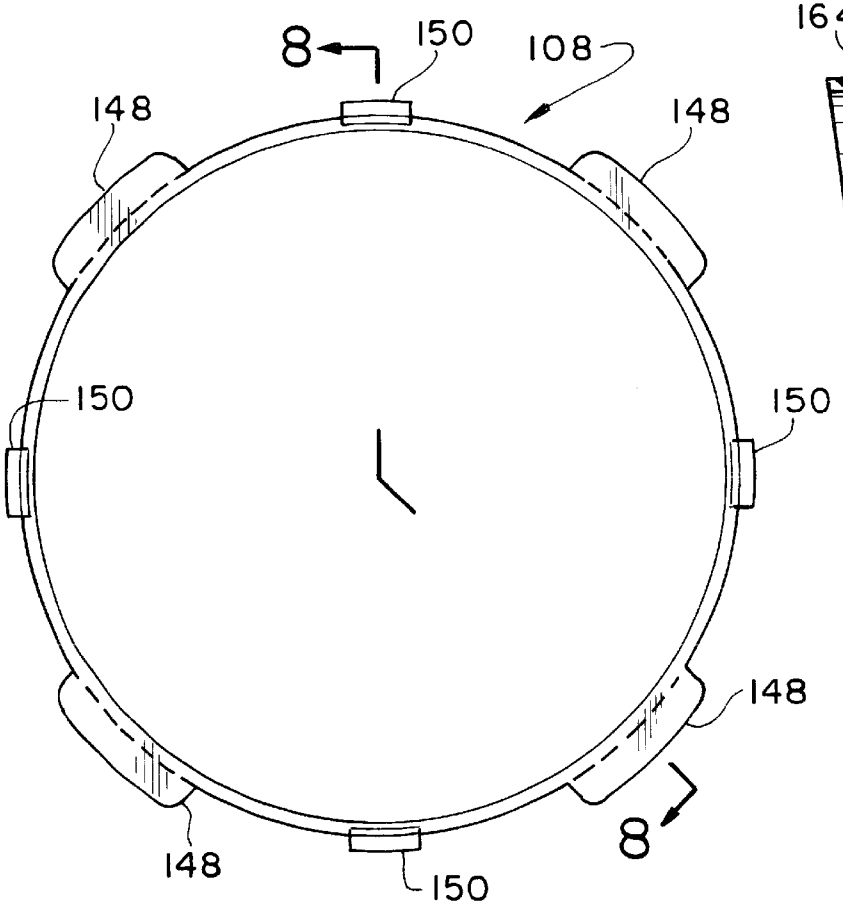
FIG. 7 is a front view on an enlarged scale of a rim component shown in FIG. 4, as seen in the direction of the line 7–7 of FIG. 4.
Figure 10:
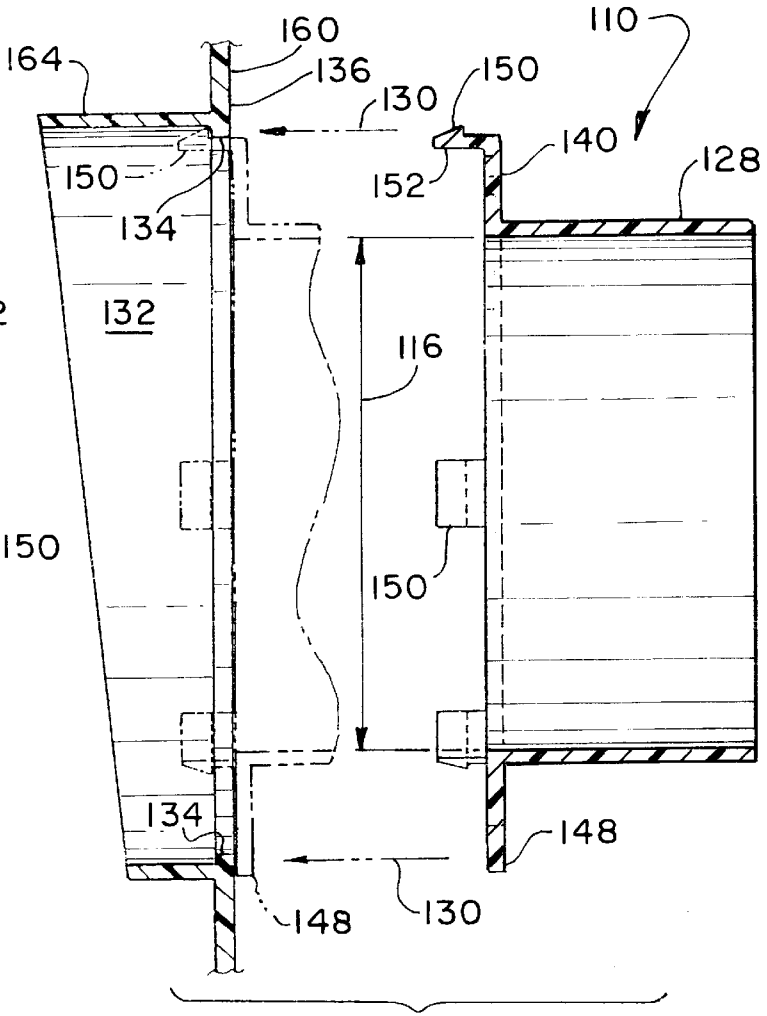
FIG. 10 is a sectional view, as taken along line 10–10 of FIG. 9.
Figure 9:
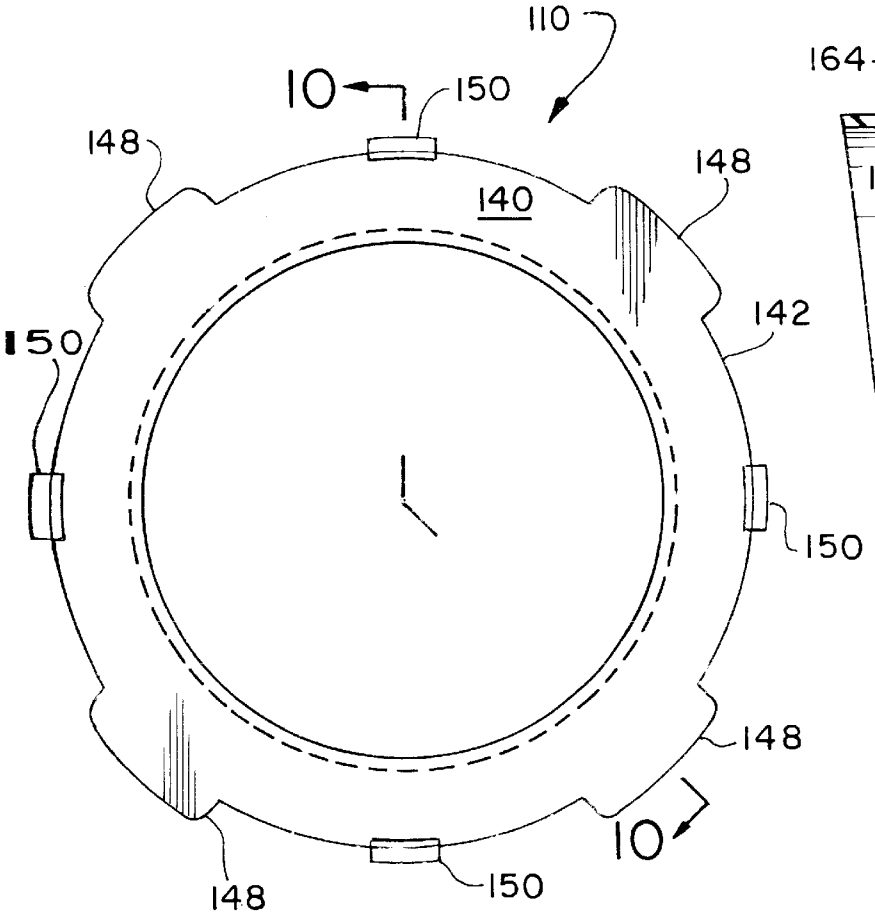
FIG. 9 is a front view of the other rim component of FIG. 4 as seen along the line 9–9 of FIG. 4.

Reference should initially be made to FIGS. 4 and 5 respectively illustrating the venting construction components according to the present invention transported to a site of installation (FIG. 4) and the assembly of these components at the site (FIG. 5), namely the location of a building with an exterior wall 100 having an interior room or space, as noted at 102, requiring the venting therefrom of gaseous matter 104 to atmosphere 106, it being assumed that until arrival at the site 100 which will permit study of the nature and volume of the gaseous matter 104 it is not known if a duct of a three inch diameter or of a four inch diameter is required based on the type of room to be vented as exemplified by the unknown of the prior art circumstances of FIGS. 1, 2, or based on the apparatus emitting the gaseous matter 104 at the room space 102 as exemplified by the prior art circumstances of FIG. 3. The venting construction components transported includes adapter rims 108 and 110, the former for a four inch installation and the latter for a three inch installation, and cooperating with either selected rim, an exhaust venting construction, generally designated 112, of known construction and operating mode. Thus, the simplified transport and installation using one of the rims 108, 110 and disregarding the unused rim, makes the required diameter correlation to a cooperating duct 114 of the two ducts also transported to the site 100, one having a diameter 116 of three inches (the duct illustrated in FIG. 5) and the unused duct of a four inch diameter 118 being retained for future use.

Underlying the present invention is the recognition that correlating the diameters 116 and 118 respectively of the selected rim 110 and duct 114 in an interfit with an encircling clamp 120 about a collar 122 of the proximal end 124 of the duct 114, typically a flexible hose 126 spanning between the collar 122 and the gaseous matter source 102; the collar being telescoped about the cylindrical body 128 of the selected rim 110, the completing of an effective flow passage 130 from the source 102 to atmosphere 106 requires an effective engagement, to be made only once, between the rim 110 to a first encountered vent opening 132 in the direction of existing flow bounded by a circular edge 134 in a closure or rear wall 136 of a vent hood 138. Since no disengaging mode is necessary and thus not provided for, rim 110 has an end flange 140 extending laterally to an edge 142 of a diameter size 144 matching the diameter size 146 of the rear wall vent opening 132, and a cammed engagement of edge 134 to the vent opening 132. To this end, circumferentially spaced tabs or stops, individually and collectively designated 148, position the outboard end of the rim 110 and vent opening 132 adjacent each other, and circumferentially spaced camming connectors, individually and collectively designated 150, of flexible plastic construction material, in response to being urged in movement in the direction of the path of the exhaust 130 through the vent opening 132 flex slightly inwardly and then resume their original diameter size-bounding positions which locates edge configurations 152 on the free ends of the connectors on one or the outboard side of the edge 134 of the vent opening 132 and the tabs 148 on the other or inboard side of the edge, thus holding the rim 110 firmly in place. Disengaging the rim 110 is possible, but difficult, but a disengaging mode is not required, an installation requirement understood and used to advantage to simplify the venting construction installation at a site-of-use.

Although what has been described suffices to provide a full understanding of the noteworthy aspects of a field installation of a venting construction otherwise of a well-known construction and operating mode, for completeness sake, a description of the venting construction 112 follows. In a preferred embodiment, the venting construction 112 includes a vent hood 138 having walls with edges 154 bounding a second encounted venting opening 156 into a compartment 158 closed by the closure or rear wall 136 having the noted vent opening 132, the hood 138 having an integral frame 160 and openings 162 thereabout to be nailed to a building or dwelling exterior wall 100. An exterior rim

164 extends to the exterior of the closure plate 136 defining a portion of the flow passage 130 and supports a pivotally mounted valve member 166 for one-way directional control of the flow path 130.

If venting required a four inch diameter duct, rim 108 would have been selected for use and not having a flange 140, the connectors 150 on this rim circumscribe the four inch diameter size for the same camming engagement to the closure plate vent opening 132 afforded by the rim 110.

While the apparatus herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. An installed at a site-of-use venting construction for venting to atmosphere an interior room of a building construction comprising, in combination:

A. a building construction having at least one interior room requiring the venting therefrom to atmosphere beyond an exterior wall of said building construction; and B. a venting construction supported on an exterior wall of said building construction having edges bounding a second encounted venting opening, a closure plate mounted over said second encounted venting opening having edges bounding a first encountered venting opening, an exterior rim extending to the exterior of said closure plate defining a flow passage of said venting construction, a pivotally mounted valve member mounted on said exterior rim, a circular connecting shoulder in encircling relation about an exterior of said edge bounding said first encountered venting opening, one selected graduated diameter sized rim from a plurality of such rims connected to extend to the interior of said first encounted venting opening preparatory to completing said flow passage of said first venting opening to said interior room, each said diameter sized rim having circumferentially spaced about connectors terminating at free ends in a wedge-shaped configuration and being of flexible plastic construction material having an operative position incident to partaking of cammed movement inwardly by said configurations into gripping engagement with said connecting shoulder of said first venting encountered opening, and a specified diameter flexible conduit as provided at said site-of-use connected in spanning relation from said interior room to said first venting opening for completing said flow passage of said encountered venting construction, said selected graduated diameter sized rim being of a diameter matching said specified diameter of said flexible conduit and having an installed connected-in-place operative position interposed between an end of said flexible conduit and said edge bounding said second venting enountered opening whereby the diameters of said flexible conduit and of said interior rim are correlated to each other and unused interior rims disposed of.

* * * * *